US007318632B2

(12) United States Patent
Bidinger et al.

(10) Patent No.: US 7,318,632 B2
(45) Date of Patent: Jan. 15, 2008

(54) STORAGE CABINET WITH LATCHING MECHANISM

(75) Inventors: Barry Bidinger, Palatine, IL (US); Jerry Draffkorn, Jr., Woodstock, IL (US); Atul Saigal, Fort Wayne, IN (US); Steve Rogman, Crystal Lake, IL (US); Robert Bergum, Woodstock, IL (US)

(73) Assignee: Knaack LLC, Crystal Lake, IL (US)

( * ) Notice: Subject to any disclaimer, the term of this patent is extended or adjusted under 35 U.S.C. 154(b) by 300 days.

(21) Appl. No.: 11/191,750

(22) Filed: Jul. 28, 2005

(65) Prior Publication Data

US 2006/0022561 A1 Feb. 2, 2006

Related U.S. Application Data

(60) Provisional application No. 60/593,007, filed on Jul. 30, 2004.

(51) Int. Cl.
*E05C 7/06* (2006.01)

(52) U.S. Cl. ..... 312/319.9; 312/218; 70/78; 49/293

(58) Field of Classification Search ..... 312/215–219, 312/222, 319.9; 292/32, 40, 42, 100, 101, 292/173, 175, 302, DIG. 11, DIG. 68; 70/78–82; 49/276, 279, 277, 278, 263, 264, 324, 328, 49/329, 293, 272
See application file for complete search history.

(56) References Cited

U.S. PATENT DOCUMENTS 964,265 A 7/1910 Johnson
1,262,459 A 4/1918 Curtis
1,449,187 A * 3/1923 O'Connor ..... 70/81
1,607,099 A * 11/1926 O'Connor ..... 312/324
1,629,213 A 5/1927 Hughes
1,774,783 A * 9/1930 Worley, Jr. et al. ..... 70/82
1,847,564 A * 3/1932 Hood ..... 292/255
1,896,745 A 2/1933 Hein (Continued)

FOREIGN PATENT DOCUMENTS

DE 954 219 12/1956

(Continued)

OTHER PUBLICATIONS

International Search Report for PCT/US2005/026776 mailed Jan. 30,2006.

*Primary Examiner*—Janet M. Wilkens
(74) *Attorney, Agent, or Firm*—McDonnell Boehnen Hulbert & Berghoff LLP

(57) ABSTRACT

A storage cabinet having a latching mechanism that can be unlatched by the use of either an upper actuator or a lower actuator is provided. The upper actuator may comprise a hand knob while the lower actuator may comprise a foot pedal. Thus, if an operator has his arms full and wants to open the doors of the cabinet, he can simply do so by actuating the foot pedal. Alternately, the doors of the cabinet may be opened by actuating the hand knob. This design affords the operator much flexibility in accessing the storage cabinet. A storage cabinet with a latching mechanism that is protected from damage under abusive conditions is also provided.

19 Claims, 10 Drawing Sheets

U.S. PATENT DOCUMENTS

| | | | | | |
|---|---|---|---|---|---|
| 1,909,804 | A | | 5/1933 | Borroughs et al. | |
| 1,940,537 | A | | 12/1933 | Faber | 292/255 |
| 1,970,267 | A | | 8/1934 | Bales | |
| 2,021,914 | A | | 11/1935 | Goulooze | |
| 2,093,317 | A | | 9/1937 | Gates | |
| 2,115,422 | A | | 4/1938 | Kahle | |
| 2,210,229 | A | | 8/1940 | Boerner | |
| 2,227,803 | A | | 1/1941 | Bales | |
| 2,348,955 | A | * | 5/1944 | Buchanan | 292/255 |
| 2,397,926 | A | * | 4/1946 | Elliott | 49/54 |
| 2,518,141 | A | | 8/1950 | Hiler | |
| 2,760,301 | A | | 8/1956 | Derr et al. | |
| 2,844,402 | A | | 7/1958 | Hughes | |
| 2,869,952 | A | | 1/1959 | Saunders | |
| 2,904,823 | A | * | 9/1959 | Perrill | 16/232 |
| 2,912,271 | A | * | 11/1959 | Schaeffer | 292/336.3 |
| 3,012,837 | A | * | 12/1961 | Morrissey, Jr. | 49/276 |
| 3,210,066 | A | * | 10/1965 | Czaplicke et al. | 49/272 |
| 3,337,281 | A | | 8/1967 | Walhout | |
| 3,462,980 | A | | 8/1969 | Fay | |
| 3,520,568 | A | | 7/1970 | White et al. | |
| 3,919,808 | A | | 11/1975 | Simmons | |
| 4,290,281 | A | * | 9/1981 | Knaack et al. | 70/54 |
| 4,303,287 | A | | 12/1981 | Taplin | |
| 4,684,178 | A | | 8/1987 | Craig | |
| 4,813,251 | A | | 3/1989 | Fowler et al. | |
| 4,875,745 | A | | 10/1989 | Trulaske | |
| 4,911,508 | A | | 3/1990 | Tillman | |
| 4,986,578 | A | | 1/1991 | Hall | |
| 5,020,834 | A | | 6/1991 | Zilkha | |
| 5,036,796 | A | * | 8/1991 | deMuy et al. | 119/481 |
| 5,076,078 | A | * | 12/1991 | Weger, Jr. | 70/54 |
| 5,110,164 | A | | 5/1992 | Whiteman et al. | |
| 5,470,115 | A | | 11/1995 | Berg et al. | |
| 5,655,798 | A | | 8/1997 | Kaveney et al. | |
| 5,782,545 | A | | 7/1998 | Kahara et al. | |
| 5,785,363 | A | | 7/1998 | Stopfer et al. | |
| 6,681,604 | B1 | | 1/2001 | Samsel | 70/78 |
| 6,209,739 | B1 | | 4/2001 | Samsel | |
| 6,328,392 | B1 | | 12/2001 | Whitcomb | |
| 6,375,244 | B1 | | 4/2002 | Smeltzer | |
| 6,883,274 | B2 | * | 4/2005 | Webb et al. | 49/293 |
| 2003/0090184 | A1 | | 5/2003 | Webb | 312/319.9 |

FOREIGN PATENT DOCUMENTS

| | | |
|---|---|---|
| DE | 1 993 393 | 9/1968 |
| DE | 2 248 866 | 4/1974 |
| DE | G 92 02 751.2 | 6/1992 |
| DE | G 92 05 640.7 | 8/1992 |
| DE | 44 24 002 C2 | 2/1996 |
| DE | 195 22 573 A1 | 3/1997 |
| EP | 0 502 824 B1 | 9/1992 |
| GB | 1090530 | 11/1967 |

* cited by examiner

STORAGE CABINET WITH LATCHING MECHANISM

FIELD OF THE INVENTION

This present invention relates to storage units and in particular storage cabinets with latching mechanisms.

BACKGROUND OF THE INVENTION

A variety of storage devices are available in today's marketplace. For instance, industrial storage cabinets may be used to store tools or other devices. In another example, storage cabinets may be used in offices to store various types of office supplies.

Storage cabinets may include a single or multiple doors, which are opened to gain entry to supplies within the storage cabinet. The doors themselves may often be locked to prevent unauthorized entry into the storage cabinet. Often, workers may want to place additional items in the cabinet. Since the worker is bringing additional items to the cabinet, he or she may be carrying these supplies in his or her arms. Thus, the worker may not be able to open the cabinet without placing the additional supplies aside or dropping the supplies in an attempt to open the doors.

Some supply cabinets include foot pedal arrangements whereby a worker, for example, may press the foot pedal and open the door. In this case, the worker would not need to place the materials being carried aside in order to open the doors of the cabinet. However, the drawback associated with these cabinets is that they can be opened only by using the foot pedal.

Thus, there is a need in the prior art for a storage cabinet having a latching mechanism that can be latched or unlatched by using either an upper actuator or a lower actuator.

There is a further need in the prior art for a storage cabinet that prevents damage to the latching mechanism under abusive conditions.

SUMMARY OF THE INVENTION

The present invention meets the shortcomings of the prior art by providing a storage cabinet having a latching mechanism that can be unlatched by the use of either an upper actuator or a lower actuator. The upper actuator may comprise a hand knob while the lower actuator may comprise a foot pedal. Thus, if an operator has his arms full and wants to open the doors of the cabinet, he can simply do so by actuating the foot pedal. Alternately, the doors of the cabinet may be opened by actuating the hand knob. This design affords the operator much flexibility in accessing the storage cabinet.

The present invention further meets the shortcomings of the prior art by providing a storage cabinet with a latching mechanism that is protected from damage under abusive conditions.

The foregoing and other advantages of the present invention will be apparent from the following more particular description of preferred embodiments as illustrated in the accompanying drawings.

BRIEF DESCRIPTION OF THE DRAWINGS

FIG. 2(*b*) is a perspective view of a recess and handle on a sidewall of the cabinet of FIG. 2(*a*).

FIG. 2(*c*) is a detailed view of the lower actuator of the cabinet of FIG. 2(*a*).

FIG. 3(*b*) is a perspective view of a latch used on the storage cabinet shown in FIGS. 1 and 2.

FIG. 5(*b*) is a top view along lines A-A of FIG. 5(*a*).

FIG. 5(*c*) is a side view along lines B-B of FIG. 5(*a*).

FIG. 6(*b*) is a side view along lines A-A of FIG. 6(*a*).

DETAILED DESCRIPTION OF PREFERRED EMBODIMENTS

Figure 1:
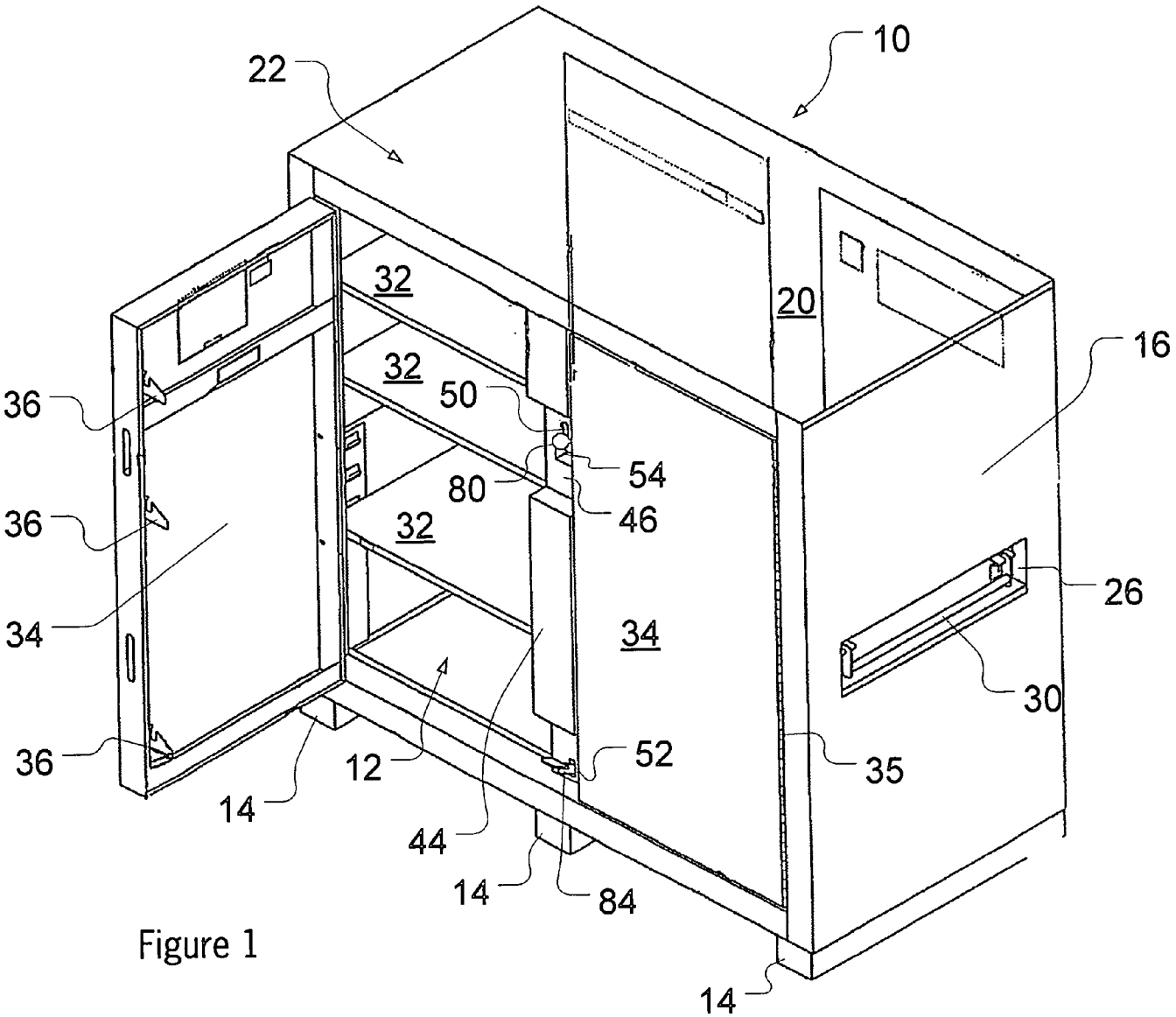
FIG. 1 is a perspective view of the storage cabinet of the present invention, with one door in the closed position.
Figure 2:
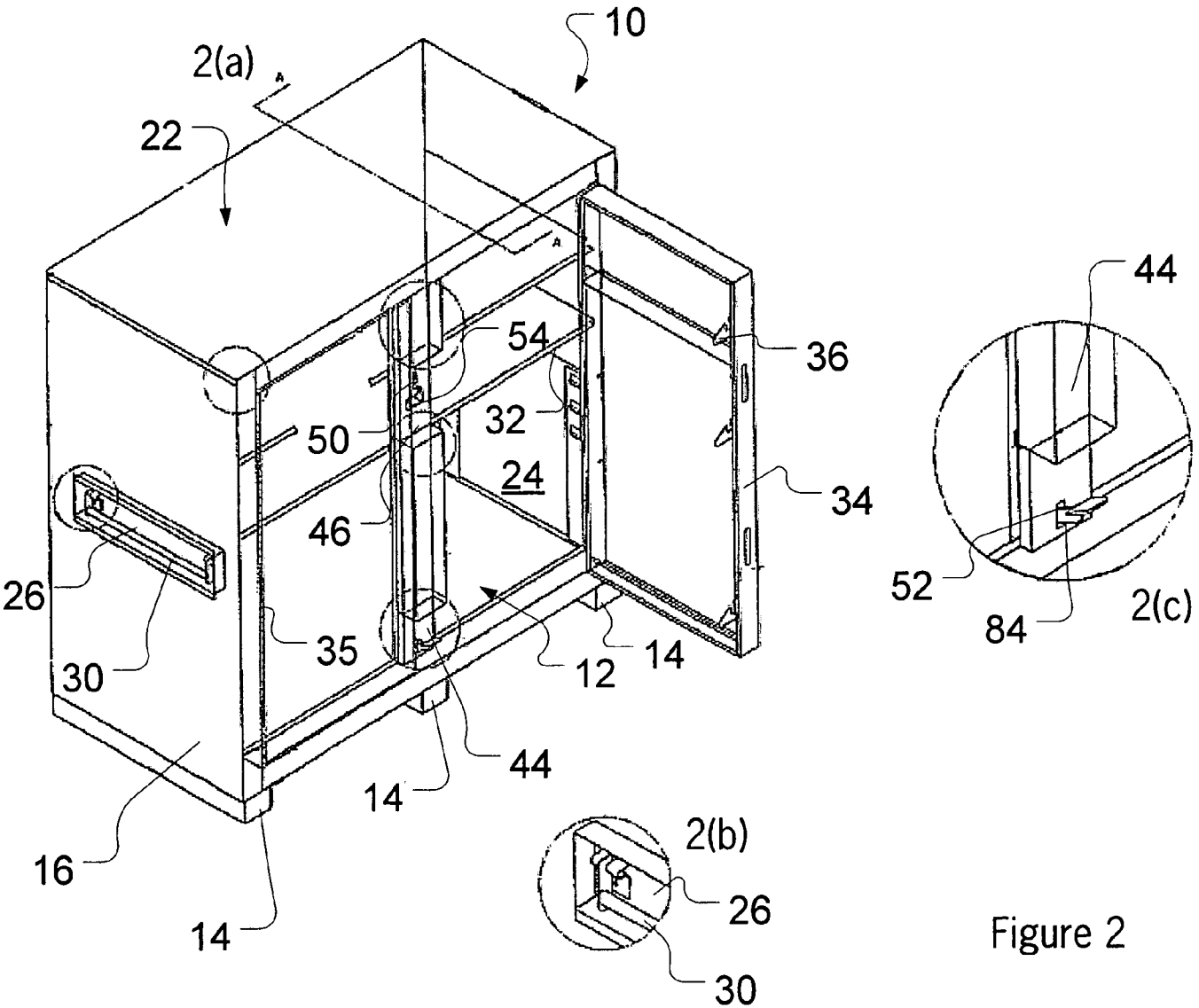
FIG. 2(*a*) is another perspective view of the storage cabinet of the present invention, with one door in the closed position.

Turning now to the drawings, a storage cabinet 10 is shown in FIGS. 1 and 2. The cabinet 10 includes a generally horizontal floor 12 supported by a number of skids 14, two side walls 16 that rise vertically from opposite lateral edges of the floor 12, a rear wall 20 that rises vertically from a rear edge of the floor 12, and a ceiling 22 that extends horizontally between the top edges of the side walls 16 and the rear wall 20. The floor 12, sidewalls 16, rear wall 20 and ceiling 22 define a storage cavity 24.

Each of the side walls 16 includes a recess 26 within which a pivoting handle 30 is mounted. The cabinet further includes three shelves 32 mounted within the cabinet 10 for the storage of items. However, the number of shelves may vary depending upon the needs of the user. The height of the shelves may also be adjusted to allow the cabinet to house different sized items.

The cabinet further includes two doors 34, each of which is pivotally coupled with a front edge of a respective sidewall 16 via a hinge type pivot 35. Each door 34 is pivotable between an open position in which the cavity 24 is accessible, and a closed position in which the door 34 abuts against the front edges of the floor 12, sidewalls 16 and ceiling 22 and prevents access to the cavity 24. Since the doors are mirror images of each other, only one door will be described with the understanding that the discussion applies to the other door as well. It should also be understood that, when describing a component of the door relative to the "front" or "rear" of the door, these directions are the same as the front and rear directions of the cabinet.

Figure 3:
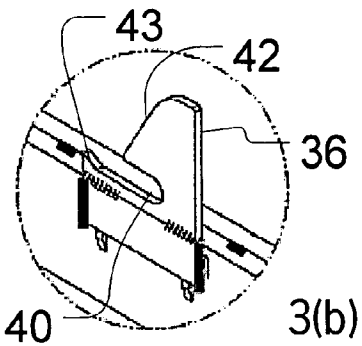
FIG. 3(*a*) is a perspective view of one of the doors of the storage cabinet shown in FIGS. 1 and 2.
Figure 3:
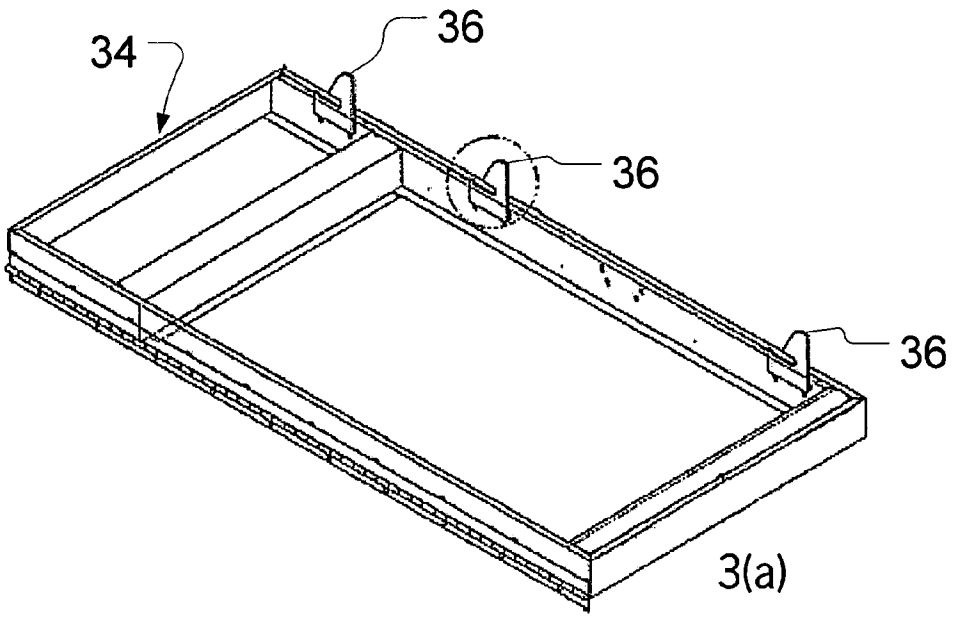

Referring to FIGS. 1-3, the door 34 includes upper, middle and lower door retaining latches 36 that are attached thereto and extend rearwardly therefrom when the door 34 is in its closed position. Each of the latches 36 includes a slot 40 for engaging a rod, a ramp portion 42, and a tang portion 43, which creates an outward force that pushes the doors away from the cabinet. Such latches 36 are disclosed in U.S. Pat. No. 6,883,274, the entirety of which is hereby incorporated by reference. Those skilled in this art will appreciate that other configurations and structures for engaging a rod may also be suitable for use with the present invention.

As shown in FIGS. 1 and 2, a center post 44 extends vertically from a central portion of the front edge of the floor 12 to a central portion of the front edge of the ceiling 22. The center post 44 includes a front panel 46. The front panel 46 includes upper and lower actuator slots 50, 52 that are generally vertically oriented, and also includes a rectangular lock aperture 54 positioned below the upper actuator slot 50.

Figure 6:
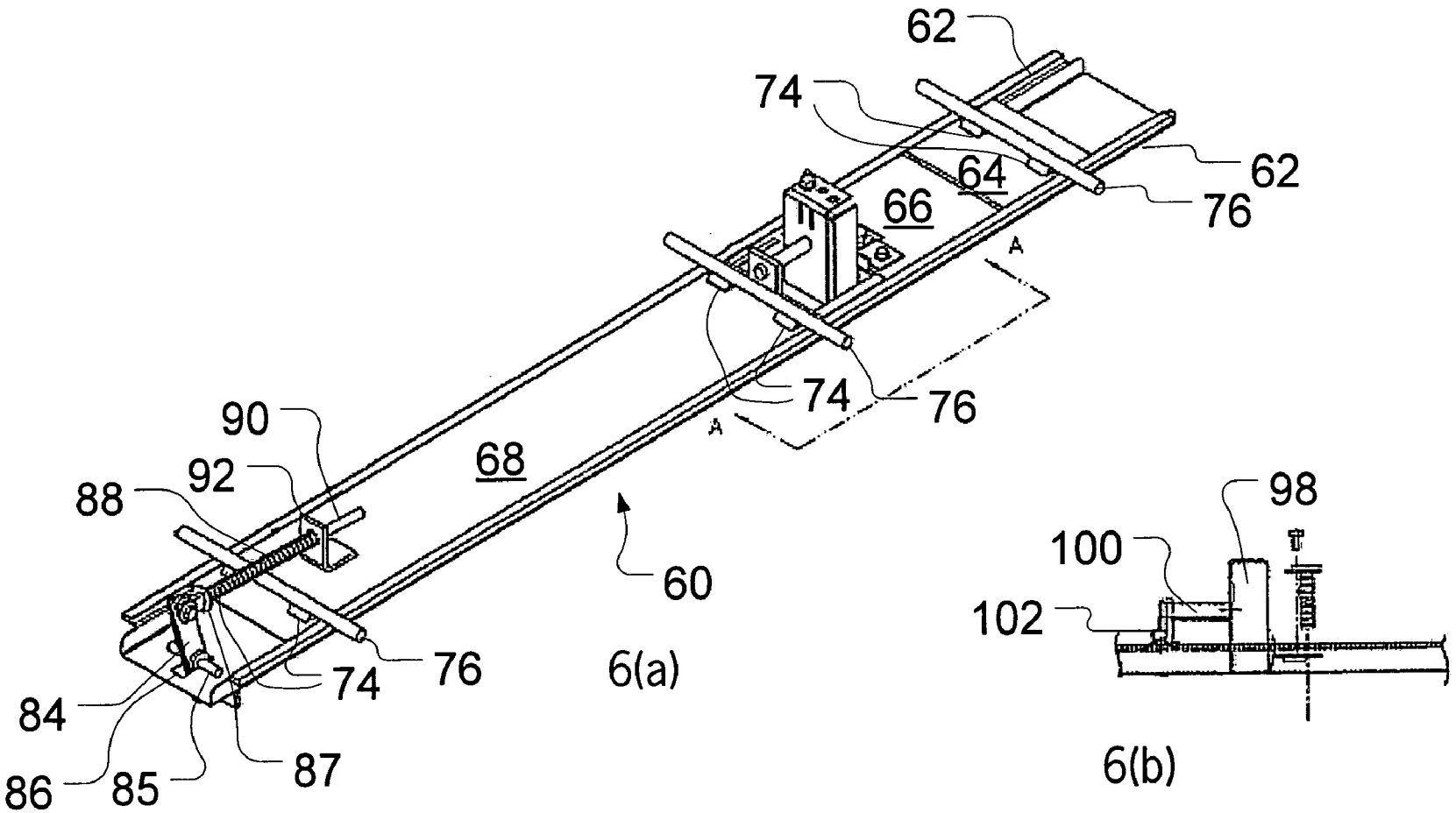
FIG. 6(*a*) is a perspective view of the latching mechanism used in the storage cabinet shown in FIGS. 1 and 2.

A latching mechanism 60, shown in FIG. 6, is provided on the rear of the center post 44. The mechanism 60 includes a pair of rails or C-shaped channels 62 located along the lateral sides of the center post 44, the rails 62 extending from the ceiling 22 to the floor 12 of the storage cabinet 10. These rails 62 allow the latching mechanism of the present invention to slide between latched and unlatched positions.

Figure 5:
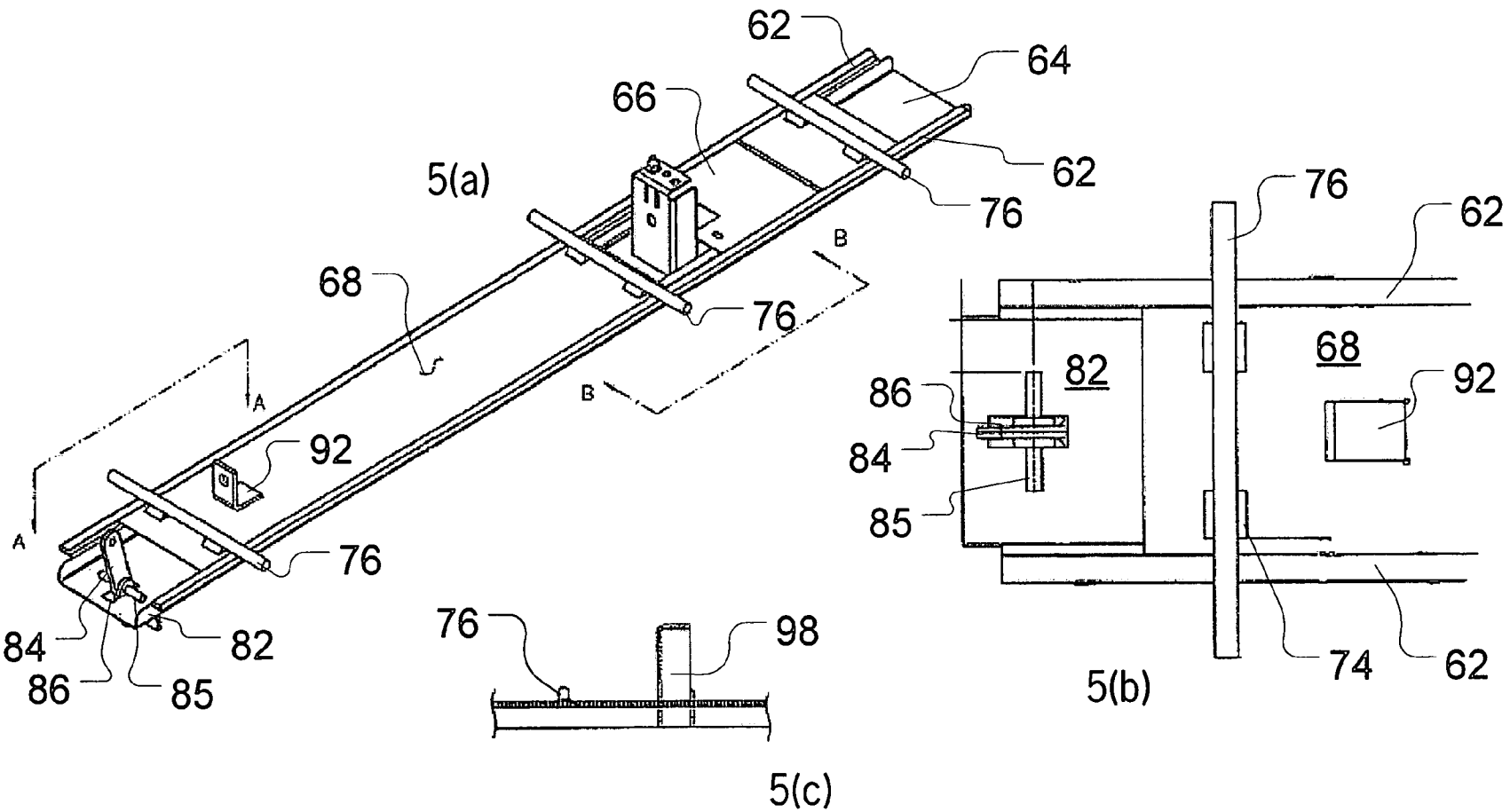
FIG. 5(*a*) is a perspective view of the latching mechanism used in the storage cabinet shown in FIGS. 1 and 2.

The latching mechanism 60 further includes a top plate 64, a middle plate 66, and a bottom plate 68, the lateral edges of which slide along the rails 62. FIGS. 5 and 6 clearly show the plates of the mechanism in sliding engagement with the rails.

Figure 4:
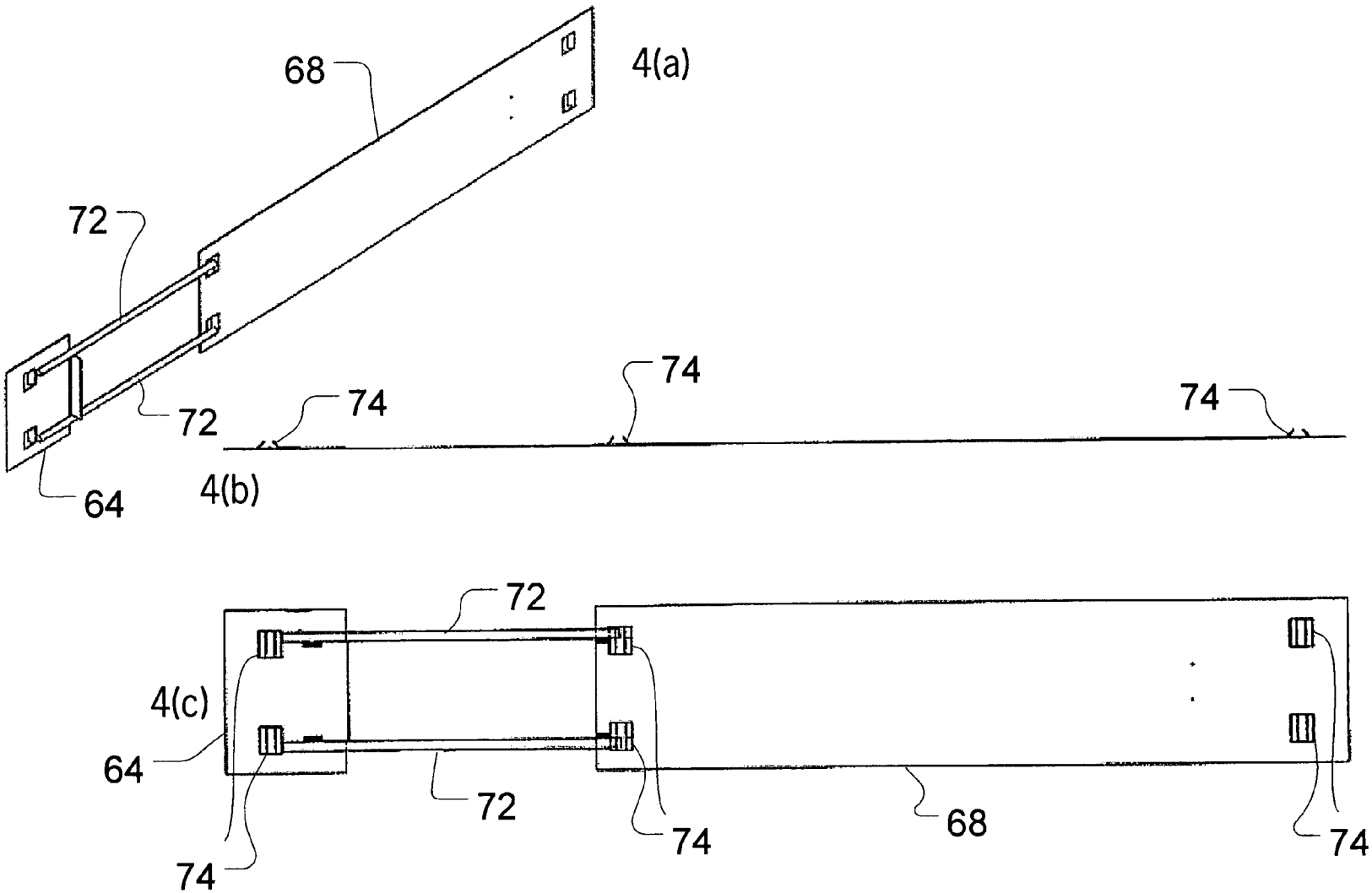
FIGS. 4(*a*)-4(*c*) are perspective, side and top views, respectively, of the top and bottom plate assembly of the latching mechanism used in the storage cabinet shown in FIGS. 1 and 2.

As can be seen from FIGS. 4*a*-4*c*, a pair of connecting rods 72 extends between the top and bottom plates, thereby connecting the plates together. This arrangement results in the top and bottom plates always moving together.

The top and bottom plates are provided with a number of protruding fingers 74. Specifically, one set of fingers is provided approximately in the middle of the top plate 64, one set at the top of the bottom plate 68, and another set at the bottom of the bottom plate 68. Each set of protruding fingers carries a rod 76, as seen in FIGS. 5 and 6. When the doors 34 of the cabinet 10 are closed, the rods 76 mate with the latches 36 provided along the doors.

Figure 7:
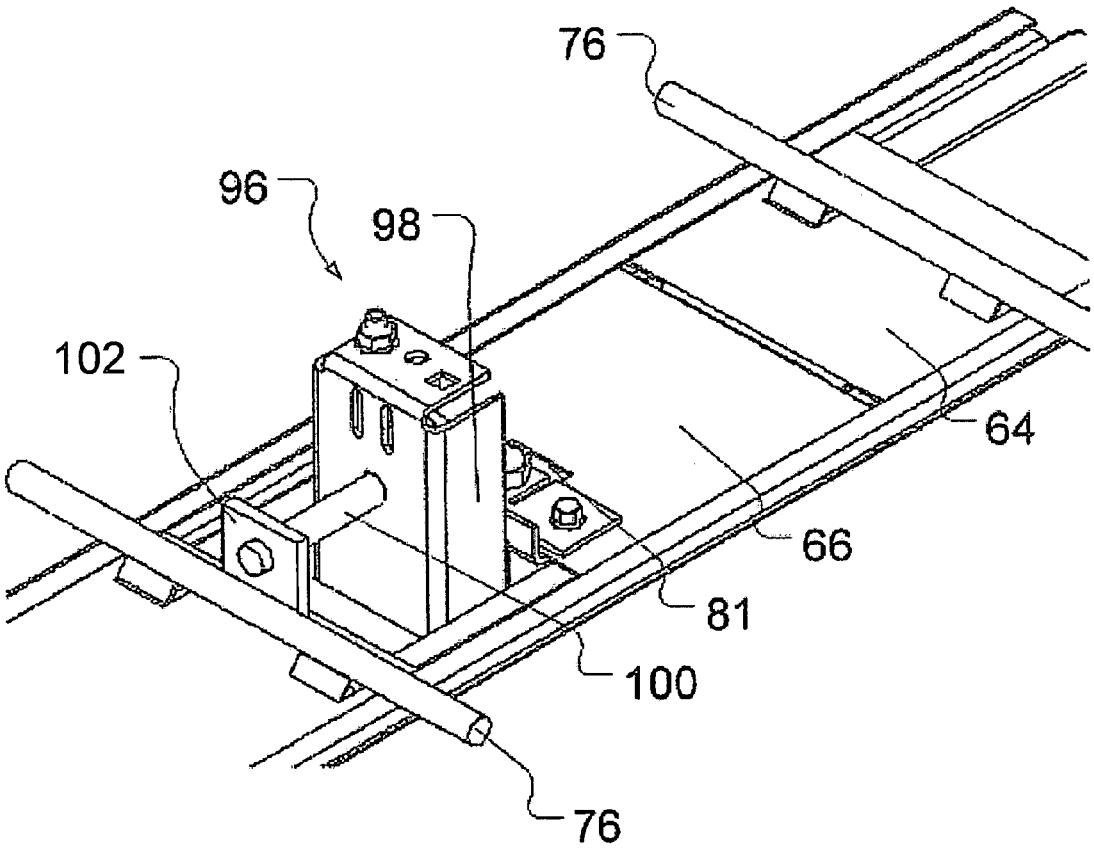
FIG. 7 is a perspective view of the locking mechanism used in the storage cabinet shown in FIGS. 1 and 2.

The middle plate 66 is provided with an upper actuator 80 that may take the form of a hand knob. The hand knob 80 comprises a knob mounted onto a shaft. The shaft of the knob extends through the upper actuator slot 50 of the center post 44 and is coupled to the middle plate 66 by appropriate means such as welding or via bolts, as shown in FIG. 7, adjacent to slot 81.

The latching mechanism 60 further includes a mounting plate 82 that is provided along the lower surface of the bottom plate 68. The mounting plate 82 functions to operatively couple a lower actuator 84 to the latching mechanism 60. The mounting plate 82 is provided with an opening 86 through which the lower actuator 84 extends.

In the preferred embodiment, the lower actuator 84 comprises a foot pedal that extends forwardly through the lower actuator slot 52 of the center post 44. The foot pedal 84 is pivotably mounted at 85 to the mounting plate 82 and operatively coupled to one end of a latch rod 90. As can be seen from FIG. 6, the latch rod 90 extends vertically upward from the foot pedal 84. The second end of the latch rod 90 extends through a support bracket 92 that is mounted on the bottom plate 68, above rod 76. The foot pedal 84 further includes a washer 87 and a compression spring 88 that is carried on the latch rod 90, sandwiched between the washer 87 and the support bracket 92.

Figure 8:
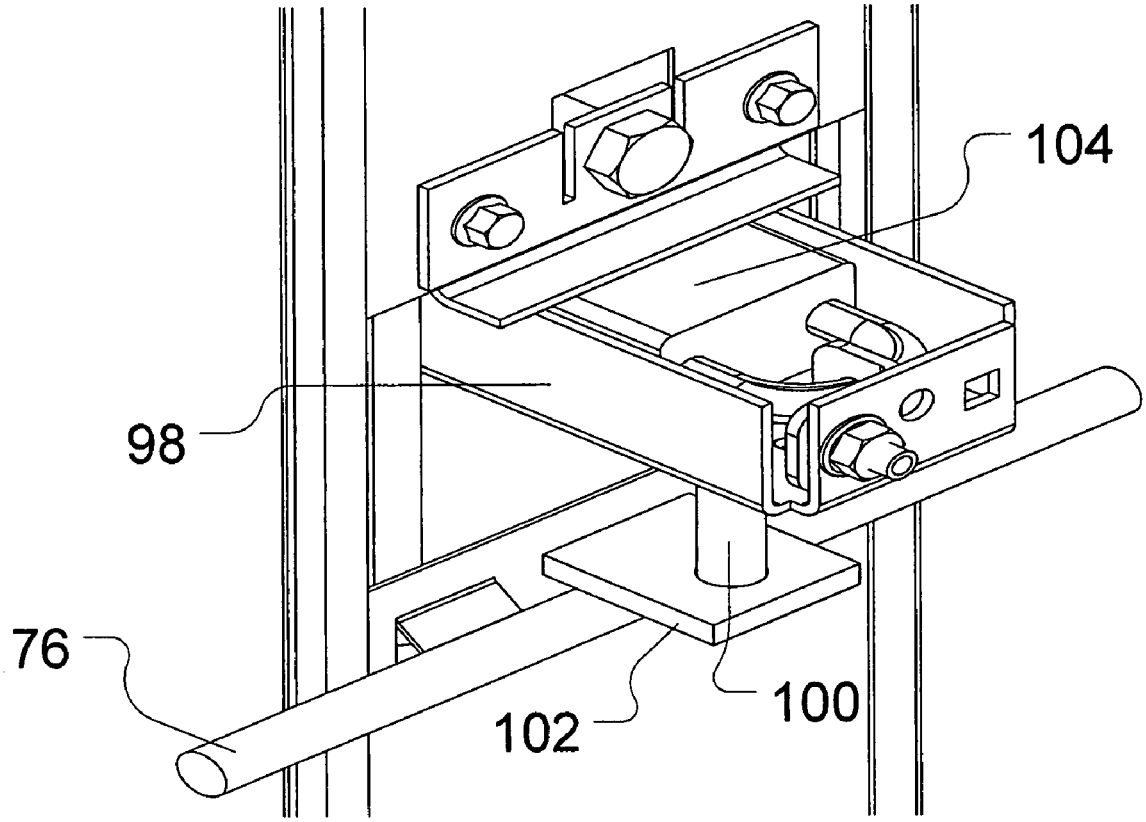
FIG. 8 is another perspective view of the locking mechanism used in the storage cabinet shown in FIGS. 1 and 2.

The storage cabinet is further provided with a locking mechanism 96. Referring to FIGS. 7 and 8, the mechanism 96 comprises a lock box 98, a security rod 100, and a transverse plate 102. The locking mechanism is used with a padlock 104. Such a locking mechanism is disclosed in U.S. Pat. No. 4,290,281, the entirety of which is hereby incorporated by reference.

The operation of the present invention will now be described. To latch the doors 34 of the cabinet 10, the doors 34 are simply moved to the closed position. The latches 36 carried by the doors 34 move past the front panel of the center post 44 and mate with the rods 76 of the latching mechanism positioned along the rear of the center post 44. Specifically, the rods 76 move upwardly along the ramped portions 42 of the latches 36 and then fall into the slot 40 of the latches 36. The latching mechanism in this position is latched.

Figure 9:
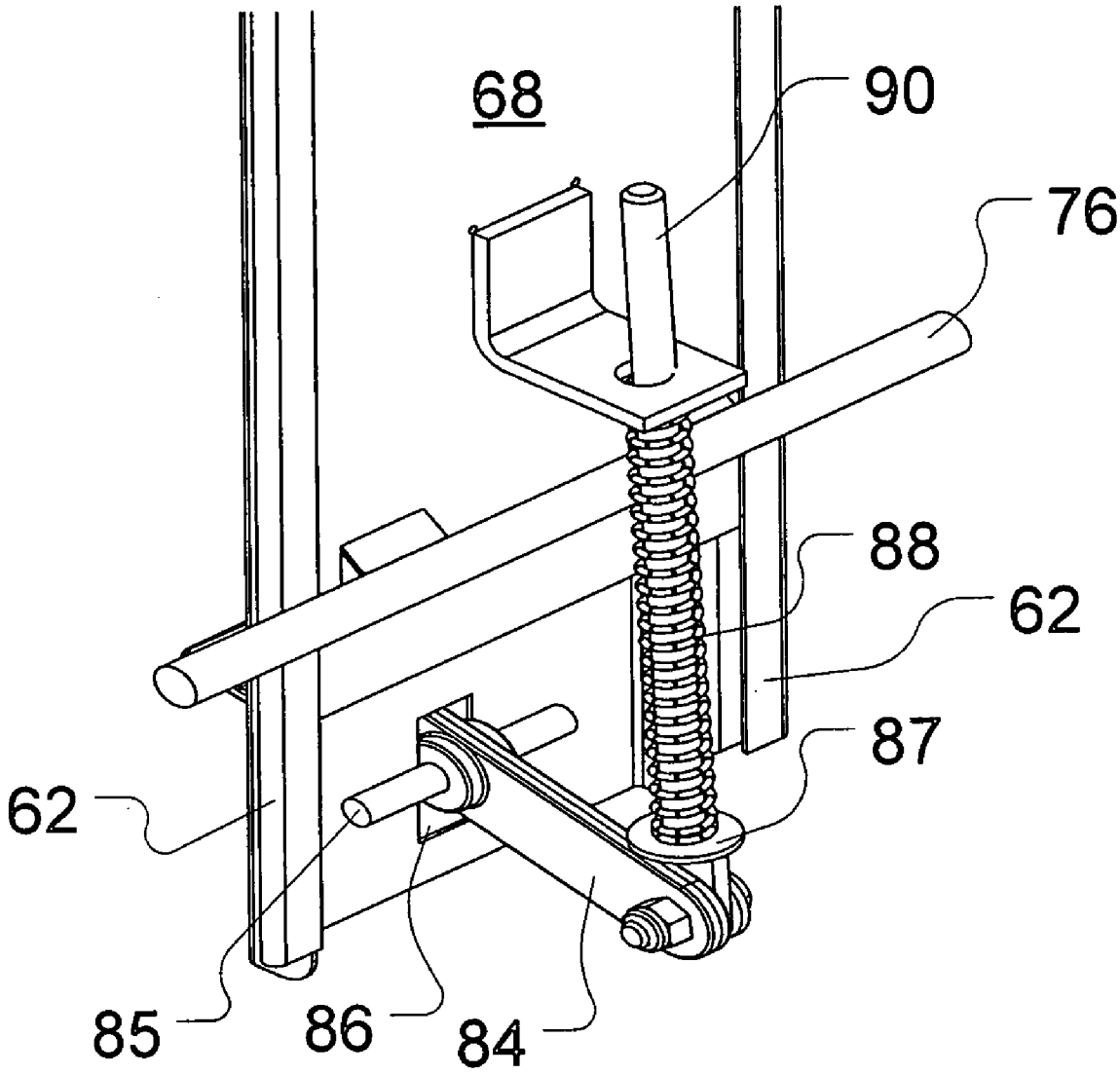
FIG. 9 is a perspective view of the lower actuator of the latching mechanism used in the storage cabinet shown in FIGS. 1 and 2.
Figure 10:
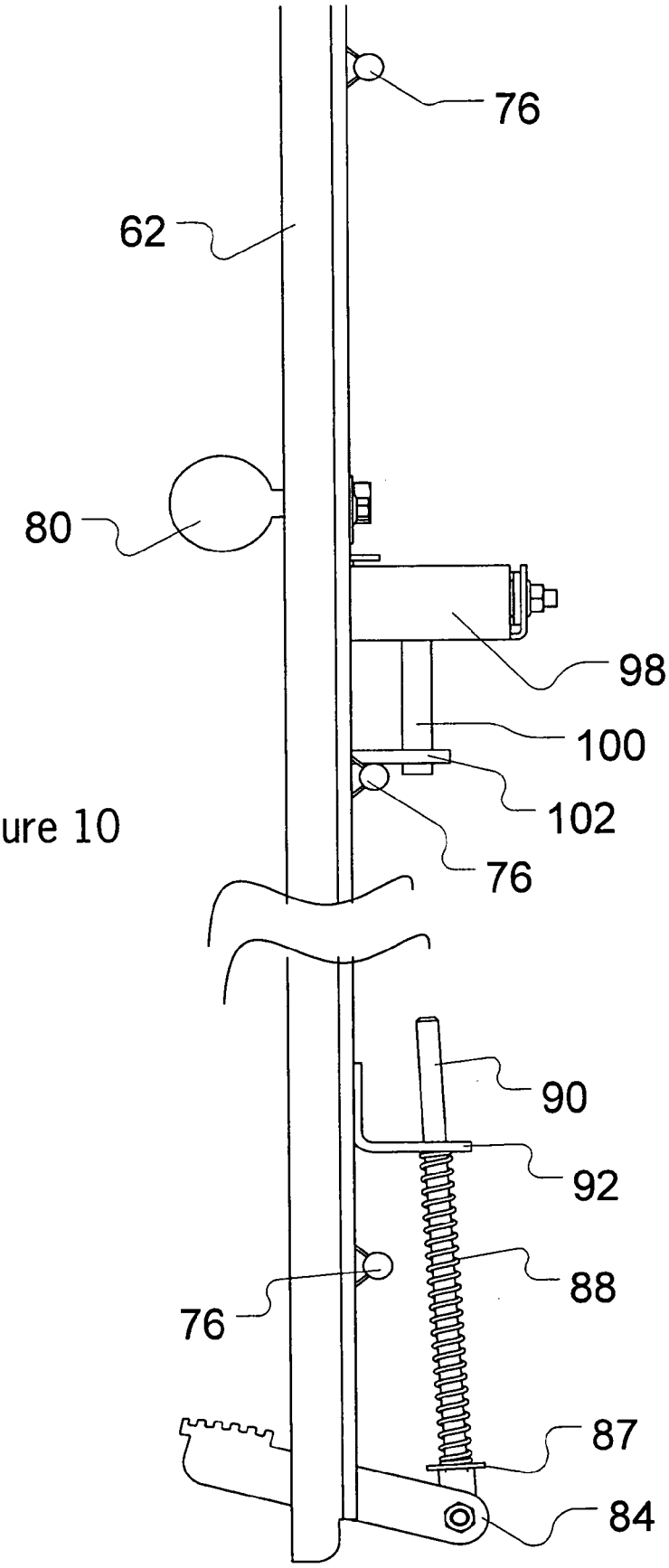
FIG. 10 is a side view of the latching mechanism used in the storage cabinet shown in FIGS. 1 and 2.

To open the cabinet 10 using the foot pedal 84, the operator simply depresses the foot pedal. With reference to FIGS. 9 and 10, the pedal 84 will pivot about the pivot point 85, thereby causing the latch rod 90 to move upwardly. This upward movement compresses the spring 88 until the spring force overcomes the weight of the top plate 64, the middle plate 66, and the bottom plate 68. Once this occurs, the spring 88 acts as a stiff spacer and pushes against the support member 92, forcing the bottom plate 68 to slide along the rails 62 and move upwardly. The upward movement of the bottom plate 68 is transferred to the top plate 64 by the connecting rods 72, thereby causing the top plate 64 to move upwardly. The middle plate 66 along with the upper actuator 80 remains stationary. The movement of the top and bottom plates lifts the rods 76 out of engagement with the latches 36. The latching mechanism in this position is unlatched.

The profile of latches 36 is designed to produce an outward force to push the doors 34 outwardly and away from the cabinet. Due to the interaction of the rods 76 with the tangs 43 on the latches, the latches 36 and thus the doors 34 are forced outwardly, away from the rods 76 and the center post 44 once the foot pedal 84 is released. Thus, the doors 34 are opened without the operator using his or her hands.

Alternately, the cabinet 10 can be opened using the hand knob 80. To do so, the operator lifts the knob 80 upwardly. As the knob 80 is coupled to the middle plate 66, lifting the knob 80 causes the middle plate 66 to slide along the rails 62 and move upwardly. The upper surface of the middle plate 66 abuts against the lower surface of the top plate 64 and in turn moves the top plate 64 upwardly. Since the top plate 64 is coupled to the bottom plate 68, the bottom plate 68 moves upwardly as well. The upward movement of the top and bottom plates lifts the rods 76 out of engagement with the latches 36, once again placing the latching mechanism in its unlatched position. The foot pedal 84 remains unaffected. Due to the interaction of the rods 76 with the latch profile, the latches 36 and thus the doors 34 are forced outwardly, away from the rods 76 and the center post 44, once the hand knob 80 is released. In this instance, the doors 34 are opened by the operator using the hand knob 80.

Due to the arrangement of the plates, actuation of the latching mechanism by the hand knob 80 is independent of actuation of the latching mechanism by the foot pedal 84. Each actuator operates independently of each other and the operator can use either actuator to open the cabinet doors.

Referring to FIG. 8, to lock the cabinet 10 the operator may add a padlock 104. When secured in a locked state, the padlock 104 shifts the body of the lock in the lock box 98 into a position where the security rod 100 can not move upwards and thus prevents either actuator from moving the rods 76 out of engagement with the door latches 36.

To unlock the cabinet 10, the operator simply uses a key to unlock the padlock 104. In doing so, the body of the padlock springs forward via the padlock's own internal spring and moves out of position of the security rod 100, thereby allowing upward movement of the latching mechanism 60 from either the upper or lower actuator.

The present invention provides protection from damage by possible intruders applying high levels of force to the foot pedal, which may lead to possible failure of the locking mechanism. If the foot pedal 84 is pressed while the cabinet 10 is in the locked position, the compression spring 88 absorbs all of the input energy and simply compresses, thereby preventing the transfer of force/energy into the latching mechanism and subsequent damage thereof.

Further, the middle plate 66 is slotted intentionally so that any abusive force placed upon the upper actuator 80 while the cabinet 10 is in the locked position will result in the bending of the upper actuator 80 via the slot 81 in the middle plate 66 while the cabinet 10 remains secured (locked).

While certain features and embodiments of the present invention have been described in detail herein, it is to be understood that the invention encompasses all modifications and enhancements within the scope and spirit of the following claims.

We claim:

1. A latching mechanism for a storage cabinet comprising:

a top and bottom plate assembly comprising a top plate and a bottom plate;

a middle plate positioned between the top plate and the bottom plate;

an upper actuator operatively connected to the middle plate; and a lower actuator operatively connected to the top and bottom plates;

wherein both actuators operate independently of each other to unlatch the latching mechanism.

2. The latching mechanism of claim 1 further comprising at least one connecting rod extending between the top plate and the bottom plate, thereby operatively connecting the top and bottom plates together.

3. The latching mechanism of claim 1 wherein the top plate and the bottom plate each comprise at least one set of protruding fingers.

4. The latching mechanism of claim 3 further comprising a rod engaged with each set of protruding fingers.

5. The latching mechanism of claim 1 further comprising a pair of rails slidably engaged with lateral edges of the latching mechanism to enable the latching mechanism to slide between a latched position and an unlatched position.

6. The latching mechanism of claim 1 wherein the upper actuator comprises a hand knob.

7. The latching mechanism of claim 1 wherein the lower actuator comprises a foot pedal.

8. The latching mechanism of claim 1 wherein the upper actuator is operated by hand.

9. The latching mechanism of claim 1 wherein the lower actuator is operated by foot.

10. A storage cabinet comprising:

a cabinet, the cabinet including at least one door;

a plurality of latches mounted onto the at least one door;

a latching mechanism mounted onto the cabinet for engaging the latches, the latching mechanism comprising a top plate, a middle plate, and a bottom plate, the middle plate being positioned between the top plate and the bottom plate;

an upper actuator operatively connected to the middle plate; and a lower actuator operatively connected to the top and bottom plates;

wherein both actuators operate independently of each other to unlatch the latching mechanism of the storage cabinet.

11. The storage cabinet of claim 10 further comprising at least one connecting rod extending between the top plate and the bottom plate, thereby operatively connecting the top and bottom plates together.

12. The storage cabinet of claim 10 wherein the top plate and the bottom plate each comprise at least one set of protruding fingers.

13. The storage cabinet of claim 12 further comprising a rod engaged with each set of protruding fingers, each rod engaging one of said latches when the at least one door is in a latched position.

14. The storage cabinet of claim 10 further comprising a pair of rails slidably engaged with lateral edges of the latching mechanism to enable the latching mechanism to slide between a latched position and an unlatched position.

15. The storage cabinet of claim 14 further comprising a locking mechanism for preventing movement of the latching mechanism to the unlatched position.

16. The storage cabinet of claim 10 wherein each latch includes a slot for engaging a rod, a ramp portion, and a tang portion.

17. The storage cabinet of claim 10 wherein the upper actuator comprises a hand knob.

18. The storage cabinet of claim 10 wherein the lower actuator comprises a foot pedal.

19. A storage cabinet comprising:

a cabinet, the cabinet including at least one door;

a plurality of latches mounted onto the at least one door;

a latching mechanism mounted onto the cabinet for engaging the latches, the latching mechanism comprising a top plate, a middle plate, and a bottom plate;

two rails positioned along the edges of the latching mechanism;

a plurality of rods, each rod engaging one of said latches when the at least one door is in a latched position;

an upper actuator operatively connected to the middle plate; and a lower actuator operatively connected to the top and bottom plates;

wherein when the upper actuator is moved upwardly, the middle plate slides along the rails and moves upwardly, causing the top and bottom plates to move upwardly, thereby lifting the rods out of engagement with the latches and placing the latching mechanism in an unlatched position; and wherein the lower actuator is unaffected by the upward movement of the upper actuator.

* * * * *